United States Patent [19]

Moore, Jr.

[11] Patent Number: 4,598,538

[45] Date of Patent: Jul. 8, 1986

[54] METHOD AND APPARATUS FOR PRODUCING AN AIR TEXTURIZED YARN

[76] Inventor: George F. Moore, Jr., 5913 F. Quail Hollow Rd., Charlotte, N.C. 28210

[21] Appl. No.: 650,830

[22] Filed: Sep. 14, 1984

[51] Int. Cl.[4] ..... D02G 3/36; D02J 1/08

[52] U.S. Cl. ..... 57/7; 57/6; 57/286; 57/289; 57/295; 57/908

[58] Field of Search ..... 57/6, 7, 9, 286, 289, 57/292, 295, 350, 908

[56] References Cited

U.S. PATENT DOCUMENTS

| | | | |
|---|---|---|---|
| 3,199,281 | 8/1965 | Marror et al. | 57/908 X |
| 4,248,036 | 2/1981 | Barron | 57/908 X |
| 4,345,424 | 8/1982 | Davis et al. | 57/350 X |
| 4,497,099 | 2/1985 | Scott | 57/350 X |

FOREIGN PATENT DOCUMENTS

| | | | |
|---|---|---|---|
| 3045941 | 7/1982 | Fed. Rep. of Germany | 57/7 |

*Primary Examiner*—Donald Watkins

*Attorney, Agent, or Firm*—Daniel E. McConnell

[57] ABSTRACT

A method and apparatus is disclsoed for producing a synthetic multifilament yarn having enhanced bulk and hand characteristics, and which is capable of high production rates. Specifically, the invention involves advancing each of at least two continuous multifilament yarn components along respective paths of travel, with a first component being advanced at a higher speed than that of a second component. Also, the second slower yarn component is guided through a liquid bath to moisten the same, while the first faster yarn component is advanced along an essentially linear path of travel and free of contact with the liquid bath, so that the degree of tension in the faster yarn component is minimized upstream of the air jet nozzle, to thereby permit full development of the loops, coils, bows or the like in the filaments thereof in the air jet nozzle. In the illustrated embodiment, the faster yarn component is advanced along a path of travel which extends through a vertical tube mounted in the liquid bath, and so that it is not wetted.

8 Claims, 3 Drawing Figures

METHOD AND APPARATUS FOR PRODUCING AN AIR TEXTURIZED YARN

The present invention relates to a method and apparatus for producing an air jet texturized yarn having desirable bulk and hand characteristics.

In conventional air jet texturizing processes, a synthetic multifilament yarn is texturized in a turbulent zone of a jet of relatively cool air to impart coils, loops, bows or other like entanglements in the filaments which provide improved bulk and hand characteristics. In this regard, a cool airstream is preferred in order to avoid plasticizing the yarn, and so that the filaments exhibit permanent deformations.

The Breen U.S. Pat. No. 2,783,609, discloses in more detail the above-described conventional air jet texturizing process and apparatus. German OS No. 2749867 and corresponding U.S. Pat. No. 4,338,776 disclose a modified air jet texturing process and apparatus, and wherein the yarn is fed through a liquid bath to moisten the yarn prior to entering the air jet texturizing device. U.S. Pat. No. 4,297,837 discloses still another texturizing process which includes a liquid application to the yarn being processed.

In an air texturizing machine presently marketed by Barmag Barmer Maschinenfabrik AG (Model FK6T-80), separate synthetic multifilament core and effect yarns are adapted to be processed, to form a resulting unitary yarn having the look of a fiber or staple yarn. In this known machine, the effect yarn is overfed, for example, by up to about 25% as compared to the withdrawal or production speed (which is typically about 300 m/min) and the core yarn is overfed by about 6 to 12%. These two yarns are guided through a water bath, and then through a common air jet nozzle to form the resulting yarn, with the core yarn imparting strength to the resulting yarn and the effect yarn imparting the desired bulk and loft.

In German OS No. 2501393, an air jet texturizing process and apparatus is disclosed wherein a plurality of multifilament yarns are fed at different overfeed rates to an air jet texturizing device. After being subjected to the air treatment, a resulting unitary yarn is produced which is withdrawn at a uniform speed. More particularly, the yarn which is more highly overfed, i.e. the effect yarn, is advanced through a liquid (water) bath, while the slower yarn is fed directly to the air jet texturizing device without passing through the liquid bath.

While the above prior air jet texturizing machines which involve advancing the effect yarn, or both the effect and core yarns, through a water bath are highly satisfactory, it has been discovered that the feeding of the faster effect yarn through the liquid bath results in substantial tension being imparted to the yarn by reason of the required deflection of the yarn through the bath, and the resistance of the water. Such tension is highly detrimental, since the tension interferes with the development of the desired bulkiness provided by the effect yarn. Thus as a practical matter, the overfeed rate of the faster effect yarn has been limited so as to minimize tension, which also limits both the degree of bulkiness which may be imparted to the resulting yarn, and the production speed of the machine.

It is accordingly an object of the present invention to provide an air jet texturizing process and apparatus which is adapted to form a plurality of multifilament yarn components into a unitary resulting yarn having desirable bulk and hand characteristics, and wherein the effect yarn may be overfed at a faster speed so as to provide a high degree of bulkiness in the resulting yarn, as well as permit a higher production speed for the apparatus.

It is a further object of the present invention to provide an air jet texturizing process and apparatus of the described type, and which is able to permit a high overfeed rate for the effect yarn, while maintaining tension in the effect yarn at a low level.

These and other objects and advantages of the present invention are achieved in the embodiments illustrated herein by the provision of a method and apparatus which includes the steps of advancing each of at least two continuous multifilament yarn components along respective paths of travel, with a first one of the components being advanced at a higher speed than that of a second one of the components. The second or slower yarn component is guided through a liquid bath to moisten the same, while the first or faster yarn component remains free of contact with the liquid bath. Finally, the advancing yarn components are fed through a high velocity air jet to form loops, coils, bows or the like in the filaments thereof and to thereby produce a unitary bulked yarn. The first faster yarn component may thus be supplied to the air jet texturizing nozzle along an essentially linear path, and without passing across deflection means or other measures which tend to significantly increase the tension of the component, and specifically without contacting the liquid bath. As a result, only the slower core yarn component is subjected to substantial tension, and the faster yarn component has substantially no tension imparted thereto, which in turn permits high overfeed rates and the development of a high degree of bulk at high production speeds.

In one preferred embodiment on the invention, the apparatus includes a tank for supporting the liquid bath, and a first deflection means is positioned outside of the liquid bath and a second deflection means is positioned in the bath itself for guiding the slower yarn component therethrough. Further, the tank preferably includes a tube extending therethrough in a generally vertical direction, and such that the path of travel of the faster yarn component passes through the tube. To the extent permitted by the overall design of the machine, the tube is preferably aligned with the path of travel of the faster yarn component leading to the inlet end of the air jet texturizing nozzle, to minimize deflection of such component.

The present invention also permits the feeding of the two yarn components, which are subject to markedly different tensions, to the air jet texturing nozzle in such a manner that they do not impede or interfere with each other. To this effect, the paths of travel of the two components are determined so that the components enter the tubular bore of the air jet nozzle at different points, i.e., at different points about the circumference of the inlet opening of the nozzle, and without contacting each other at the inlet opening. For this purpose, the outlet of the yarn tube in the liquid tank, and the point at which the slower yarn component emerges from the liquid bath, are disposed at a distance from each other such that the components advance into the entry end of the air jet nozzle at an acute angle which usually is less than about 45 degrees, preferably less than about 30 degrees, and most preferably in a range between about 8 and 25 degrees. Also, the axis of the tubular air jet nozzle is angled with respect to the path of travel of at least the moistened core yarn component so that the moistened yarn component contacts the entry end of the air jet nozzle and any excess moisture is wiped therefrom.

Some of the objects of the invention having been stated, other objects and advantages will appear as the description proceeds, when taken in connection with the accompanying schematic drawings, in which—

Figure 1:
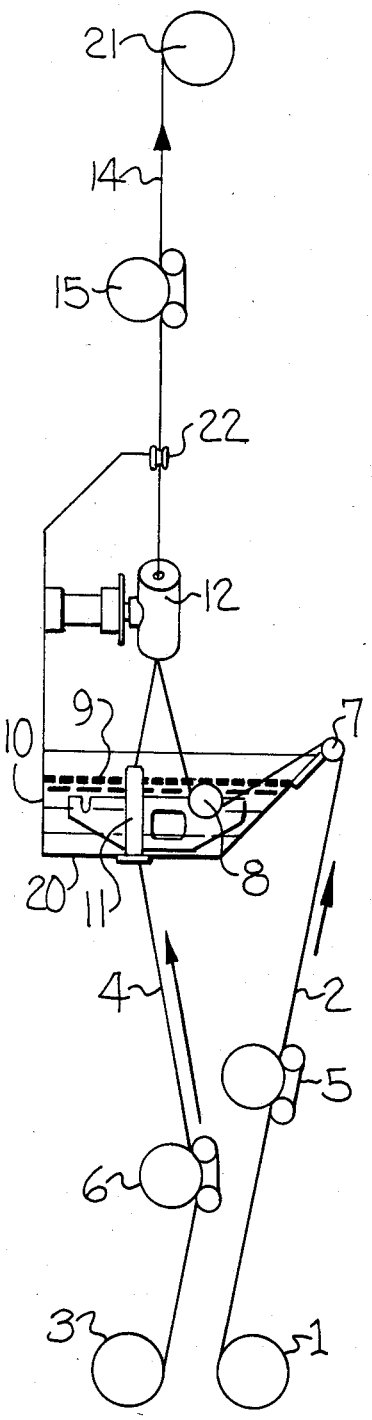
FIG. 1 is a side elevation view illustrating one embodiment of the method and apparatus of the present invention.

Referring more particularly to the drawings, FIG. 1 schematically illustrates a preferred embodiment of the air jet texturizing process and apparatus according to the present invention, and which includes an air jet texturizing nozzle 12. Two continuous multifilament yarn components 2, 4 are advanced along a path of travel to the nozzle 12, with the yarn component 4 being advanced at a higher speed than that of the second yarn component 2. Thus the yarn component 4 represents what is commonly called the "effect" yarn, and the yarn component 2 represents the "core" yarn. The yarn component 2 is withdrawn from the supply package 1 by feed means 5 which determines the speed of the yarn component 2. The component 2 then advances to a first deflection means 7, for example a yarn guide or a yarn guide roller, which is positioned on the rim of the water tank 10 above the level of the water bath 9. From the first deflection means 7, the component 2 is guided to a submerged second deflection means 8, preferably also a roll or roller, so as to pass through the water bath 9. The moistened yarn component 2 then advances upwardly to the inlet end 13 of the tubular air jet nozzle 12.

The yarn component 4 is withdrawn from the supply package 3 by the feed means 6 at a predetermined speed which exceeds the speed of the component 2, and is supplied from the yarn feed means 6 to the nozzle inlet 13 along an essentially linear path of travel, and without significant deflection. Thus, the component 4 enters into the nozzle with the component 2, and the two components proceed to the turbulent zone of the nozzle. During its path of travel to the nozzle inlet 13, the component 4 passes through the water tank 10 by advancing through a tube 11. The yarn tube is fixed to the bottom of the water tank so as to be watertight, and it extends in a generally vertical direction upwardly through the tank to a point above the highest water level. Also, the tube 11 is preferably aligned to the extent possible with the path of travel of the component 4, so that the component passes essentially freely through the tube. By this construction, the yarn component 4 advances from the feed means 6 to the inlet 13 of the nozzle along an essentially linear path, and without contacting anything. In the event such guidance of the component 4 is not feasible for spacial or other reasons dictated by the overall design of the machine, the yarn may be deflected, preferably as little as possible, at one or both ends of the yarn tube 11. As will be apparent, it is important that any increase in the yarn tension caused by such a deflection be minimized to the extent possible, and the tube 11 may incorporate a ceramic guide at each end for this purpose.

The resulting unitary yarn 14 which is produced in the turbulent zone of the nozzle 12 is withdrawn by the feed means 15 and fed to the take-up roll 21. If desired, the yarn may be subjected to a mechanical stabilizing treatment, a heat setting treatment, an additional air jet treatment, or any combination thereof, during its travel between the feed means 15 and the take-up roll 21.

Figure 3:
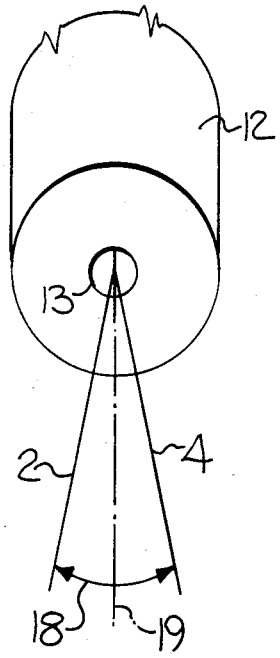
FIG. 3 is a fragmentary side elevation view illustrating the entry end of the air jet nozzle.
Figure 2:
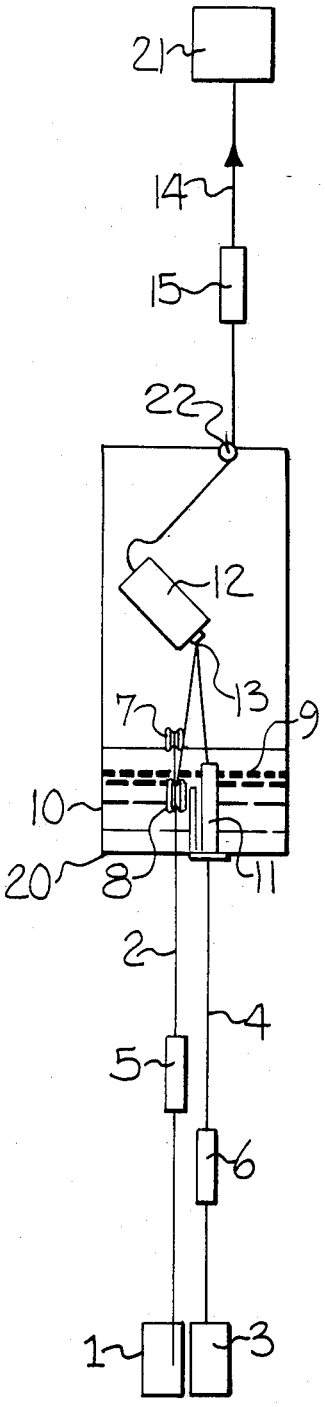
FIG. 2 is a front elevation view of the apparatus shown in FIG. 1.

The orientation of the axis of the tubular nozzle 12 will depend upon the design of the particular nozzle employed. For example, where a Du Pont air jet nozzle is employed, the axis is inclined laterally with respect to the plane defined by the two yarn components 2 and 4, by an angle of about 45 degrees and as illustrated in FIG. 2. Upon leaving the nozzle, the resulting yarn is deflected laterally by the well known "Coanda" effect, which provides additional entanglement of the filaments. The resulting yarn then passes over the guide 22, and to the feed roll 15 and package 21. It has also been found to be advantageous if the angles which the two yarn components 2 and 4 form with a projection 19 of the axis of the nozzle as illustrated in FIG. 3, are substantially the same. Also, it is preferred that the two components enter the tubular bore of the nozzle at different points about the circumference of the opening, and without contacting each other at the inlet opening. To achieve this result, the angle 18 between the two components is usually less than 45 degrees, preferably less than about 30 degrees, and most preferably in a range between about 8 and 25 degrees. Also, the angled orientation of the axis of the nozzle as described above results in moistened yarn component contacting the entry end of the nozzle so that any excess moisture is wiped therefrom.

From the above description, it will be apparent that the present invention is able to achieve a high degree of bulkiness, since the overfeed rate of the faster yarn component or effect yarn may be substantially increased by reason of the absence of tension being applied to such yarn upstream of the air jet nozzle. Specifically, the present invention has been found to permit the effect yarn to be overfed at a rate up to about 45 percent greater than the withdrawal speed, with the core yarn being advanced at a rate up to about 12 percent. Also, production speeds up to about 900 m/min have been achieved. Thus the present invention is able to not only substantially improve the bulkiness of the resulting yarn, but it also provides considerably improved productivity and unique physical characteristics in the resulting yarn.

In the drawings and specification, there has been set forth the preferred embodiments for the practice of the present invention, and although specific terms are employed, they are used in a generic and descriptive sense only and not for purposes of limitation, the scope of the invention being defined in the following claims.

That which is claimed is:

1. A method of producing a synthetic continuous filament yarn having desirable bulk and hand characteristics, and comprising the steps of:

advancing each of at least two continuous multifilament yarn components along respective paths of travel extending between yarn feeding means and a common air jet nozzle, with a first one of said yarn components being advanced at a faster speed than that of a second one of said yarn components, said paths of travel forming an angle therebetween such that said yarn components do not contact each other at the entry end of the air jet nozzle, moistening the advancing slower yarn component while the faster yarn component remains free from contact with the moisture, and feeding the advancing yarn components concurrently through the air jet nozzle while contacting the entry end of the air jet nozzle with the moistened slower yarn component and wiping any excess moisture therefrom and while subjecting the yarn components to a high velocity jet to form loops, coils, bows or the like in the filaments thereof and produce a unitary bulked yarn.

2. The method as defined in claim 1 wherein the moistening step comprises passing the advancing slower yarn component through a liquid bath.

3. A method of producing a synthetic continuous multifilament yarn having desirable bulk and hand characteristics, and comprising the steps of advancing each of at least two continuous multifilament yarn components along respective paths of travel between yarn feeding means and a common air jet nozzle, with a first one of said yarn components being advanced at a faster speed than that of a second one of said yarn component, moistening the slower second yarn component as it advances along its path of travel by passing the same through a liquid filled tank, while passing the faster yarn component upwardly through said liquid filled tank as it advances along its path of travel and while maintaining the faster yarn component separated from the liquid in the tank, and while feeding the advancing yarn components concurrently through the air jet nozzle after having passed through said liquid filled tank, and while subjecting the same to a high velocity air jet to form loops, coils, bows or the like in the filaments thereof and produce a unitary bulked yarn.

4. The method as defined in claim 3 wherein the path of travel of said first faster yarn component is essentially linear along the entire length thereof.

5. The method as defined in claim 4 wherein the paths of travel of the first and second yarn components form an angle therebetween at the entry end of the air jet nozzle and do not contact each other at the entry end of the nozzle.

6. An apparatus for producing a synthetic continuous multifilament yarn having desirable bulk and hand characteristics, and comprising:

high velocity air jet nozzle means, yarn feeding means for advancing each of at least two continuous multifilament yarn components along respective paths of travel extending between the yarn feeding means and said nozzle means, with a first one of said yarn components being advanced at a higher speed than that of a second one of said yarn components, means positioned along the path of travel of said second slower yarn component for applying moisture to said second slower yarn component and comprising tank means for containing a liquid bath, a tube extending through said tank means in a generally vertical direction, and means for guiding said second slower yarn component through said bath while said first faster yarn component passes through said tube and remains free of contact with said moisture, whereby the high velocity air jet nozzle means is adapted to form loops, coils, bows or the like in the filaments of the advancing yarn components passing therethrough to produce a unitary bulked yarn.

7. The apparatus as defined in claim 6 wherein said means for guiding said second slower yarn component through said liquid bath comprises a first yarn deflection means positioned outside of the liquid bath and a second yarn deflection means positioned in the bath itself for guiding said second yarn component therethrough.

8. The apparatus as defined in claim 6 wherein said high velocity air jet nozzle means comprises a tubular air jet nozzle positioned above said bath.

* * * * *